United States Patent [19]

Kornely

[11] Patent Number: 4,807,767

[45] **Date of Patent: * Feb. 28, 1989**

[54] SELF BALANCING ELECTRIC HOIST

[75] Inventor: Michael Kornely, Centerport, N.Y.

[73] Assignee: Grumman Aerospace Corporation, Bethpage, N.Y.

[ * ] Notice: The portion of the term of this patent subsequent to Apr. 21, 2004 has been disclaimed.

[21] Appl. No.: 43,379

[22] Filed: Apr. 28, 1987

Related U.S. Application Data

[63] Continuation-in-part of Ser. No. 563,679, Dec. 20, 1983, Pat. No. 4,658,971.

[51] Int. Cl.[4] ..... B66C 13/12

[52] U.S. Cl. ..... 212/159; 318/628

[58] Field of Search ..... 212/156, 158, 159; 901/9; 318/430, 434, 628

[56] References Cited

U.S. PATENT DOCUMENTS

| | | | |
|---|---|---|---|
| 3,043,444 | 7/1962 | Melton | 212/20 |
| 3,166,023 | 1/1965 | Lynd, Jr. | 105/163 |
| 3,179,259 | 4/1965 | McLean | 212/11 |
| 3,254,289 | 5/1966 | Hartman | 318/430 |
| 3,375,938 | 4/1968 | Crittenden | 212/13 |
| 3,476,263 | 11/1969 | Komatsu et al. | 212/14 |
| 3,532,324 | 10/1970 | Crittenden | 254/144 |
| 3,598,440 | 8/1971 | Ramsden | 294/67 |
| 3,635,442 | 1/1972 | Ulbing | 254/168 |
| 3,642,148 | 2/1972 | Durand | 212/48 |
| 3,713,129 | 1/1973 | Buchholz | 340/267 |
| 3,743,107 | 7/1973 | Verschoof | 212/125 |
| 3,752,325 | 8/1978 | Sato et al. | 212/35 |
| 3,758,079 | 9/1973 | Workman, Jr. et al. | 254/168 |
| 3,848,750 | 11/1974 | Hoge | 212/69 |
| 3,856,266 | 12/1974 | McKendrick | 254/168 |
| 3,866,048 | 2/1975 | Gieschen et al. | 318/628 X |
| 3,904,156 | 9/1975 | Smith | 244/118 |
| 3,916,279 | 10/1975 | Kawano et al. | 318/430 |
| 3,945,504 | 3/1976 | Wright | 212/14 |
| 3,986,703 | 10/1976 | Brett | 254/173 |
| 4,039,086 | 8/1977 | Ray | 212/47 |
| 4,067,446 | 1/1978 | Ray | 212/48 |
| 4,107,590 | 8/1978 | Pury et al. | 318/628 |
| 4,198,857 | 4/1980 | Preux | 73/141 |
| 4,283,764 | 8/1981 | Crum et al. | 318/628 X |
| 4,313,165 | 1/1982 | Clelford et al. | 318/628 X |
| 4,541,029 | 9/1985 | Ohyama | 318/430 X |

FOREIGN PATENT DOCUMENTS

| | | | |
|---|---|---|---|
| 742094 | 9/1966 | Canada | 254/175 |

OTHER PUBLICATIONS

Module-Air Lifting and Balancing Units/Zimmerman Engineered In-Process Material Handling Equipment and Systems.

Air-Hoist/A Product of Alamance Machine Products Co., Inc.

ARO/Loadleader Hoists.

Space Age Weightless Handling for Your Production Line/Coleman Equipment.

*Primary Examiner*—Joseph F. Peters, Jr.

*Assistant Examiner*—Stephen P. Avila

*Attorney, Agent, or Firm*—Scully, Scott, Murphy & Presser

[57] ABSTRACT

The specification discloses a self-blancing screw jack that is responsive to small manually applied "upset" loads to move the load in the desired direction. A strain gauge measure the total load and is used to establish a null signal representative of the load at rest. This nulled signal is then continuously compared with the actual load signal. When the actual load signal varies from the preset nulled signal by a predetermined value, the drive motor is actuated to drive the load in the direction of the variance. A non-reversible gear means is used to support the load in the at rest position.

14 Claims, 5 Drawing Sheets

SELF BALANCING ELECTRIC HOIST

CROSS REFERENCE TO RELATED APPLICATIONS

This application is a continuation-in-part of my prior application, U.S. Ser. No. 563,679, filed Dec. 20, 1983, which issued as U.S. Pat. No. 4,658,971 on Apr. 21, 1987.

FIELD OF THE INVENTION

This invention relates to a control system and mechanism for operating and controlling an electric self balancing hoist.

BACKGROUND OF THE INVENTION

Heretofore, self balancing hoists have been primarily pneumatic. Pneumatic or air balanced hoists are useful in many industrial applications in which a relatively heavy load such as a work piece or tool is suspended at a certain height and manually repositioned by the operator. The tool or work piece is raised or lowered by a pneumatic piston. An air pressure regulator controls the air pressure to bias the piston and thereby raise or lower the load. These self balancing pneumatic hoists have a means or regulator for adjusting the air pressure to balance the load in a suspended position. Once balanced, the load may be easily manipulated by an operator by applying a small upset force in the desired direction of travel.

DESCRIPTION OF THE PRIOR ART

U.S. Pat. No. 3,916,279 to Kawano, et al. discloses an electrical self balancing device having a specific disclosure for an electrical circuit for off-setting the frictional losses in the system. In the device illustrated in Kawano, et al., the motor windings must remain energized to hold the load, even when the load is static. A non-reversing drive means is not employed.

U.S. Pat. Nos. 3,866,048 and 4,283,764 described electrically driven, power assist drive means, wherein one or more strain gauges between a portion directed by the operators hand, and the primary load to be driven, generate a signal that is used to energize a motor to move the primary load to be driven. In these references the strain gauge measures only the operator input, not the entire load to be balanced. A non-reversing drive means is not employed.

U.S. Pat. No. 3,758,079 entitled "Control System for Balancing Hoist" is illustrative of a pneumatically operated balancing hoist that utilizes air pressure and an expansible chamber hoist motor. The control system utilizes a pneumatic pressure regulating valve and a sensor in the hoist motor chamber to balance the load.

U.S. Pat. No. 3,752,325 entitled "Loading Balancer" discloses a pedestal type load balancer for manipulating a tool or workpiece.

U.S. Pat. No. 3,642,148 entitled "Device for Achieving Permanent Equilibrium in Tower Cranes" and U.S. Pat. No. 4,039,086 entitled "Load Balance, Double Bucket Cable Stay Crane with Load Sensing Means" both disclose electrically operated cranes having traveling hoist buckets wherein the position of the hoist bucket is regulated to some extent by electronic load sensors to insure equilibrium for the crane. The purpose of these devices is to ensure and evenly balanced load on either side of the crane tower.

U.S. Pat. No. 3,476,263 entitled "Device for Preventing the Swaying of the Suspending Means in a Crane" and U.S. Pat. No. 3,904,156 entitled "External Load Stabilization Apparatus" both disclose an electric hoist having electronic load sensors and electric motors for damping sway in a load supported by plural hoists.

U.S. Pat. No. 3,986,703 entitled "Movement of Scenery in Theaters and Studios" discloses load handling system for moving theatrical flats and scenery in a theater. The load first weighed and a signal representing its weight is stored. This signal is then extracted from storage when the hoist moves the flat to provide a torque for balancing the load weight. This reference, however, does not disclose any means for upsetting the balancing signal, or any means for establishing an operator assisted updrive or downdrive for use in repositioning signal, or any means for establishing an operator assisted updrive or downdrive for use in repositioning the flat.

The present invention may be distinguished from the above prior art devices in that no operator skill is needed to balance the load. When the up or down/drive switch is released, the load is automatically balanced by actuating a single switch. The prior art air balancers require the operator to adjust a pressure regulator to balance the load.

In addition, the present invention may be distinguished from the prior art air balancers in that the force required to lift the load is adjustable and limited only by the electric hoist capacity. Thus, the hoist may handle loads as heavy as 15,000 pounds, while conventional pneumatic balancers are limited to approximately 2,000 pounds. The upset force is independent and adjustable, and not a value proportional to the load. By placing an electrical load sensor between the load and the means for supporting the load, the upset force may be measured directly, wherein derivative values based on the pressure in a pneumatic chamber ar inherently limited by the frictional load in the system.

Finally, the present invention provides a smooth precision movement with no over run. The air balancing systems require an upset force that is greater than the movement force. This results in an over run for small movements when the operator desires to reposition the load.

SUMMARY OF THE INVENTION

The present invention is an electric self balancing hoist. It provides the load capacity of a large electric hoist to maneuver large heavy workpieces at work stations which require repetitive work operations. The use of electrical load sensors provide for a smooth precision movement with no over run. In the event of a power failure, the electric hoist locks in position. No operator skill is needed to balance the load. The circuitry may also be configured to provide for automatic balancing of the load when the up or down switch is released. The amount of upset force needed to move the load in the desired direction can be adjusted electronically to match the normal load in the working environment.

The present invention utilizes an electric motor which drives a drum hoist or a screw jack to raise and lower the load as desired. The motor is controlled by both the automatic balancing circuit and a manual operator switch which may be activated by the operator to raise or lower the load. The electric motor is responsive to an updrive signal to raise the load and a downdrive signal to lower the load. The balancer includes an inline load sensing device such as a load cell or a strain gauge and bridge circuit. The load cell provides signal representative of the actual load that is carried by the electric self balancing hoist. The output of the load cell is amplified, coverted to digital form and nulled out by a digital up/down counter, which in effect generates an adjustable null signal that will offset the actual load signal. The output of the counter is converted back to an analog signal and returned to the summing amplifier to complete the null circuitry. The output of the summing amplifier is then used to control the electric drive motor. This output is compared with either an upload reference voltage or a download reference voltage to determine if the loading has exceeded a predetermined value. In this manner, the amount of upset force needed to unbalance the hoist may be adjusted. The upset force can be set as low as one pound in either direction. The output of the summing amplifier, when cancelled by the null signal generating means in the balancing circuitry is essentially zero. Thus, the jack motor is motionless, and the load is held in a fixed position. When the operator desires to move the load downwardly, he presses downwardly on the load adding a few pounds to the load carried by the host. The load cell will sense the increase in load, and will generate an actual load signal that is greater than the null signal sent to the summing amplifier. This increase in the actual load signal is then compared with the download reference voltage, and if it exceeds the reference signal, the comparator will then activate a downdrive amplifier to drive the jack motor in a downward direction. Conversely, if the operator desires to raise the load, the operator can lift the load upwardly thereby reducing the amount of the actual load signal below that of the null signal supplied to the summing amplifier. The load at rest signal then goes negative, and the upload comparator will compare the load at rest signal with the upload reference voltage. When it has exceeded the predetermined value, the comparator will energize the updrive amplifier which will in turn activate the jack motor to drive the load upwardly. Thus, the operator is able to raise or lower the load by manually loading the load in the desired direction of travel to generate an actual load single that exceeds the null signal by either of the predetermined values. In either event, the motor will continue to drive the load upwardly or downwardly until the comparator circuit sees no difference between the reference signal and the actual load signal. At such time, the comparator output will drop to zero, and the downdrive or updrive amplifier will be disabled, thus shutting down the jack motor.

The amount of upset force needed to initiate the updrive or downdrive action may be altered by adjusting the reference voltage. An upset force of one to several pounds may be entered merely by changing reference voltage to reflect the desired loading. In the event the output of the load cell is substantially non-linear, a suitable adjustment may be inserted for providing various reference voltage windows for different weight categories. So long as the output of the load cell remains linear, however, a one pound upset force is equally applicable to both a 100 pound load and 10,000 pound load.

It is therefore, an object of the invention to provide an electric load balancing hoist having an expanded load capacity by providing balancing and control circuitry for large electric hoists.

It is another object of the invention to provide a traveling hoist mounted on an overhead support wherein a pair of electric balancing hoists are suspended from reciprocating carriages. In this manner, unusually large and unwieldly loads may be balanced and moved for repetitive work station operations.

It is a further object of the present invention to provide an electric balancing circuit for an electrically actuated screw jack hoist. A screw jack hoist is particularly suited for moving and manipulating large loads by virtue of its precise movement.

It is still a further object of the invention to provide an electric balancing hoist wherein no operator skill is needed to balance the load. The load may be automatically balanced by depressing a balance switch, or in an alternate embodiment of the invention, the load may be balanced when the up or down switch is released by the operator.

BRIEF DESCRIPTION OF THE DRAWINGS

FIG. 1(*a*) is a diagrammatic illustration of a worm gear helix, illustrating the axis, the pitch L, and its relationship to pitch cylinder circumference.

FIG. 1(*b*) is a diagrammatic illustration of a pinion drive and helical gear arranged for driving a drum hoist.

DETAILED DESCRIPTION OF THE PREFERRED EMBODIMENT

Figure 1:
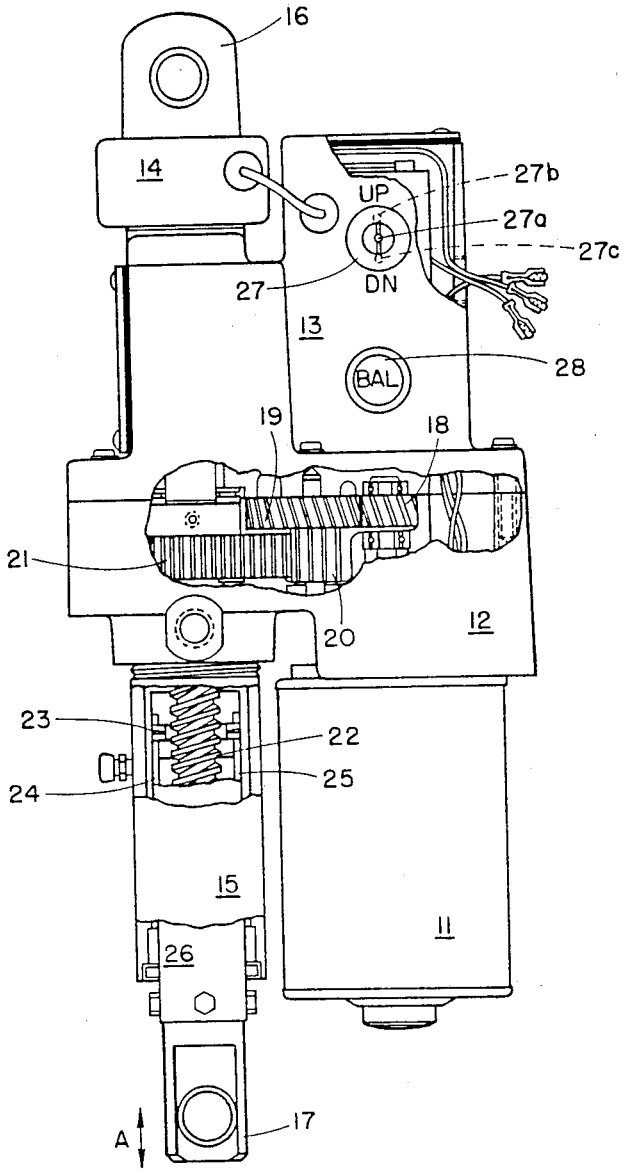
FIG. 1 is a frontal view of an electric self balancing hoist which utilizes a screw jack lifting mechanism, wherein portions of the frontal view are broken away for interior views.
Figure 1A:
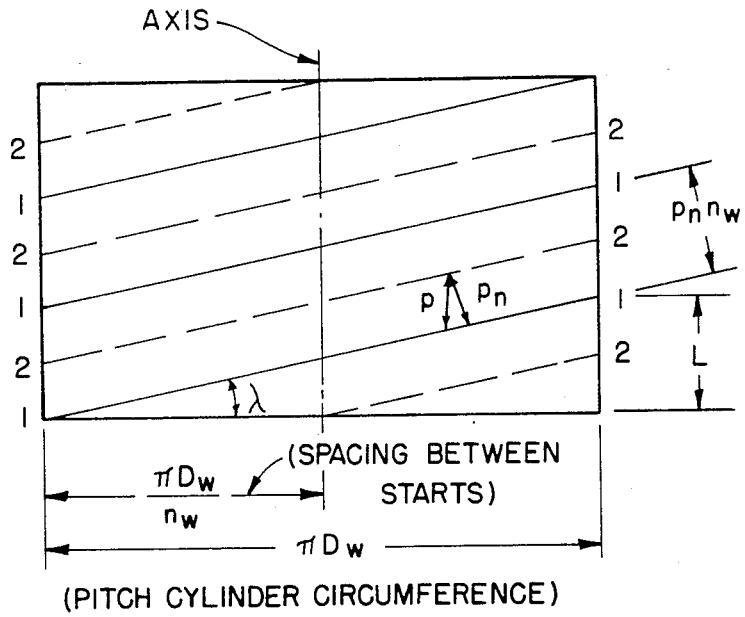
Figure 1B:
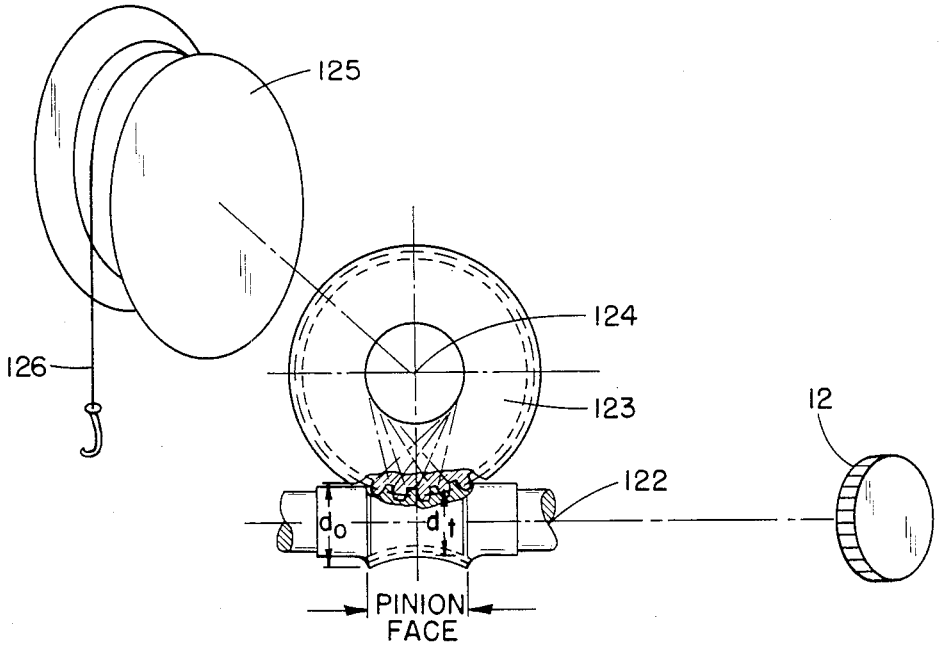

Referring to FIG. 1, the electric self balancing hoist includes an electric motor 11, a transmission means 12, balancing and control circuitry generally contained in the control box 13, a load cell 14, and a rotary to linear conversion mechanism 15. As illustrated in FIG. 1, the rotary to linear conversion mechanism is a non-reversing screw jack which translates the rotary motion from transmission means 12 into linear movement between the hoist support lug 16 and the lifting bridle 17. The term non-reversing refers to a unique feature of certain worm drives which occurs by virtue of the large amount of sliding between the driving and driven member. For any given coefficient of friction, there is a critical value of lead angle L, as illustrated in FIG. 1(*a*) below which the mesh is non-reversible, i.e. the load carried will not cause the gear mesh to reverse when the driving force is removed. The driving member must be rotated for movement to occur and may be rotated in either direction. This angle is generally 10° and lower, but is related to the materials and lubricants used. This non-reversing feature may be found in transmission means which use a sliding incline type of drive, i.e. worm drive, jack screws, pinion drives and the like, all of which may be paired with a variety of driven members such as helical gears, racks or screw followers. The embodiment illustrated in FIG. 1 discloses a rotating stationing jack screw, and a moveable screw follower, although a rotating drive member, and reciprocating jack screw could be used.

Likewise, when used with a pinion drive, as illustrated in FIG. 1(*b*), the present invention may be used to drive a drum hoist. As illustrated in FIG. 1(*b*) the gear reduction or transmission 12 would incorporate the pinion drive gear 122, which drives a helical cut gear 123. The drum hoist 125 rotates about axis 124, and is driven by helical gear 123, to lift a load via cable 126. The non-reversing pinion 122, 123 will hold the drum stationary when the driven motor and transmission means is de-energized. This together with the normal high ratio of non-reversing drives enables the use of a much smaller drive motor for the drum hoist, since the non-reversing transmission means holds the load during static periods, rather than the motor windings, as is the case with conventional electric motor balancing drives. The only time the motor is energized is when the drum or jack is being driven up or down.

FIG. 1(*a*) is taken from *Mark's Standard Handbook for Mechanical Engineers*, published by McGraw Hill, Inc. (Copyright 1978), pages 8–112. The descriptive matter for the figure, illustrating the remainder of the design criteria and formulas relevant to worm gear design may be found on pages 8–111 and 8–112, said pages being incorporated herein by reference thereto. As illustrated in FIG. 1, the rotary motion of motor 11 is directed to an output spur gear 18 which drives a first reduction gear 19 which is fixably mounted to the secondary drive spur 20. Drive spur 20 is again reduced by output spur gear 21 to achieve an approximate 100 to 1 reduction between the rotation of motor 11, and output gear 21. Output gear 21 is in turn fixably connected to jack screw 22 which converts the rotary motion of the transmission means 12 into linear reciprocation by means of screw follower 23. Screw follower 23 and screw shaft 26 reciprocate along guides 24, 25 within the hoist to provide for the reciprocal movement of the lifting bridle 17 as motor means 11 is rotated.

In an experimental embodiment of the invention, motor means 11 rotated at 1750 rpm and provided a linear output motion along screw shaft 26 of two inches per minute.

As illustrated in FIG. 1, a load cell 14 is positioned between the load supported from the load lifting bridle 17, and a support means which supports both the hoist and the load by means of lug 16. Load cell 14, in the experimental embodiment, was a strain gauge in a wheatstone bridge circuit which provided an actual load signal proportional to the load between support lug 16 and load lifting bridle 17.

The control circuitry for motor 11 is contained in control box 13 and will hereinafter be described in greater detail with respect to FIG. 4. Control box 13 also provides a mounting for an updrive/downdrive switch 27 and a momentary balancing switch 28.

In operation, the operator attaches the support lug 16 to a fixed support, or to a moveable overhead carriage. The lifting bridle 17 is affixed either to the load or to a flexible connector such as a chain used to support the load. The screw shaft 26 may then be reciprocated up or down as indicated by the arrow A by means of the up/down switch 27. Switch 27 has a central neutral position 27*a*, and updrive position illustrated by dotted lines in 27*b* and a downdrive position illustrated by dotted lines 27*c*. After the load has been positioned by means of the up/down switch 27, the operator momentarily depresses balance switch 28 to automatically create an adjustable null signal that offsets the actual load signal generated by load cell 14. At this point, the hoist is at rest, and supports the load from load support means 17. If the operator desires to raise the load, the load is lifted manually to upset the balance maintained by the load balancer. When urged in the direction of travel, the actual load signal generated by load cell 14 will be greater than a predetermined reference signal previously entered into the load balancer. When the reference level is exceeded, motor 11 will be energized in the desired direction of travel to raise or lower the load.

Figure 2:
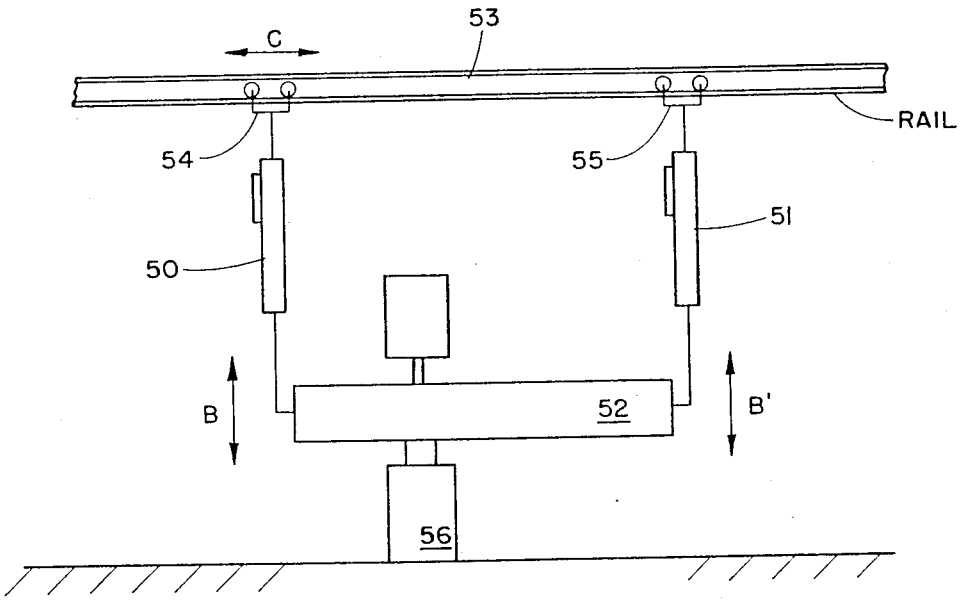
FIG. 2 is a diagrammatic elevation view of a pair of electric self balancing hoists suspending a workpiece to be manipulated.

As illustrated in FIG. 2, a pair of load balancers 50 and 51 are used to suspend a large load 52 from support rail 53 by means of traveling hoist carriages 54 and 55. The large workpiece 52 is positioned at a work station 56 for welding, riveting, scribing or other operations involving significant workpiece movement. The present invention is particularly suited to the manipulation of large workpieces in tools wherein a high number of repetitive operations must be performed on the workpiece at the same work location. Alternately, the hoist may be sued to position a tool in front of a large workpiece wherein the tool is used to perform a large number of operations on a single workpiece. As illustrated FIG. 2, the workpiece 52 may be raised or lowered along the axis of the arrows B—B′ by simply generating a small lift of two or three pounds upward, which generates an updrive signal in both hoists 50 and 51. Conversely, depressing the load 52 by a few pounds will generate a downdrive signal in the electric hoist 50 and 51. The small amount of upset force needed to initiate movement of the workpiece 52 will remain constant provided the output of the load cell 14 remains linear. Thus, an upset force of two pounds will effectively move a workpiece of 100 pounds, or 10,000 pounds with equal ease. As indicated in FIG. 2, the workpiece may be moved up and down in the directions of arrows B—B′ and reciprocated linearly by the overhead hoist carriages in the direction of arrows C.

Figure 3:
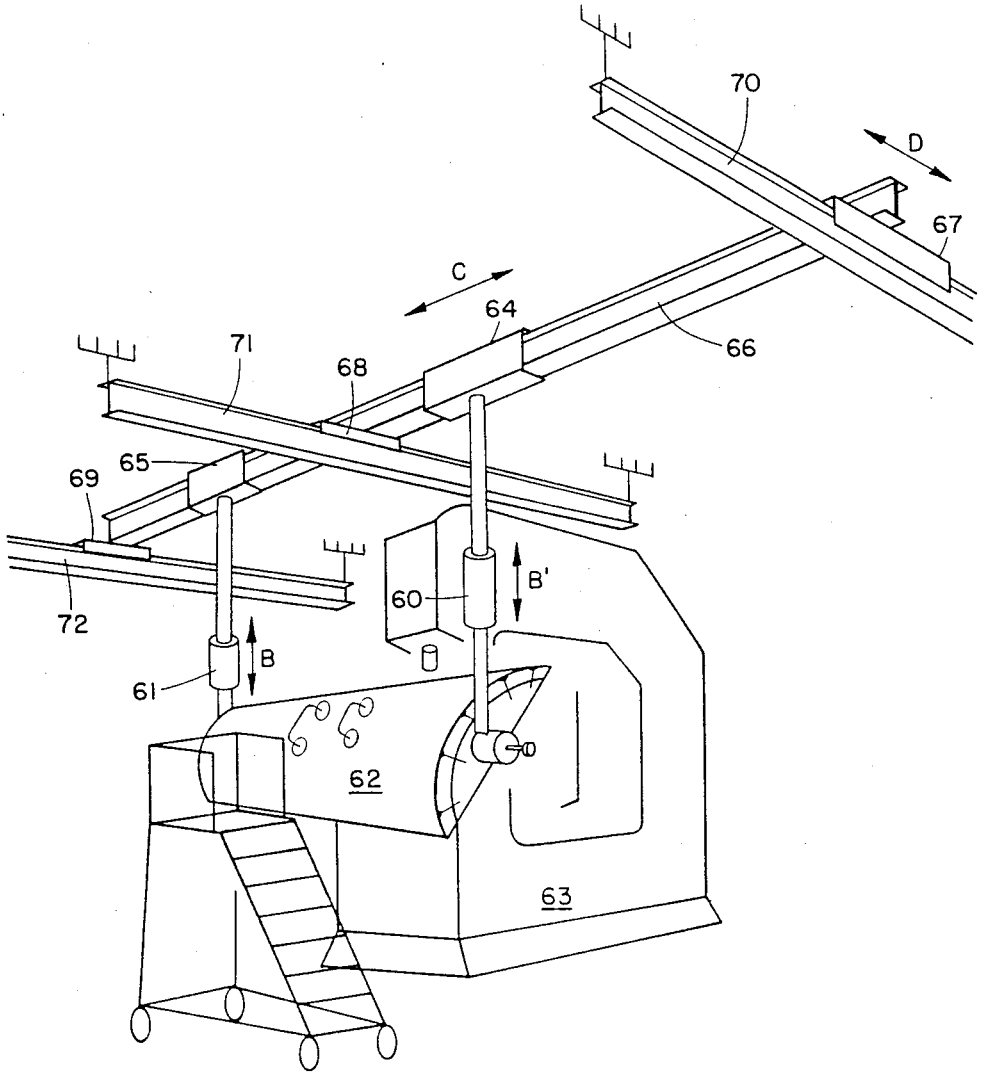
FIG. 3 is a diagrammatic elevation view of another embodiment of the invention illustrating a pair of self balancing electric hoists used to manipulate a large workpiece in an automatic riveting machine.

As indicated in FIG. 3, a second pair of self balancing electric hoists 60 and 61 are used to support a large aircraft wing 62 in an automatic riveting machine 63.

The electric self balancing hoists 60 and 61 are supported by means of reciprocal traveling hoist carriages 64 and 65 which are carried by traveling beam 66. Traveling beam 66 is in turn supported by carriages 67, 68 and 69 upon stationary support beams 70, 71 and 72.

In operation, the aircraft wing 62 can be raised or lowered in the directions indicated by the arrows B—B′, and may be reciprocated along a linear axis indicated by the arrow C by means of the traveling hoist carriages 64 and 65. The entire assembly may be reciprocated into and out of engagement with the riveting machine 63 as indicated by the arrow D by means of carriages 67–69. Thus, a large cumbersome and relatively fragile workpiece 62 may be easily manipulated within a fixed work station 63 by a single operator to perform a high number of repetitive operations on the workpiece. As indicated previously, the invention finds particular utility in riveting or spot welding machines wherein a high number of repetitive operations must be performed on a single workpiece.

Figure 4:
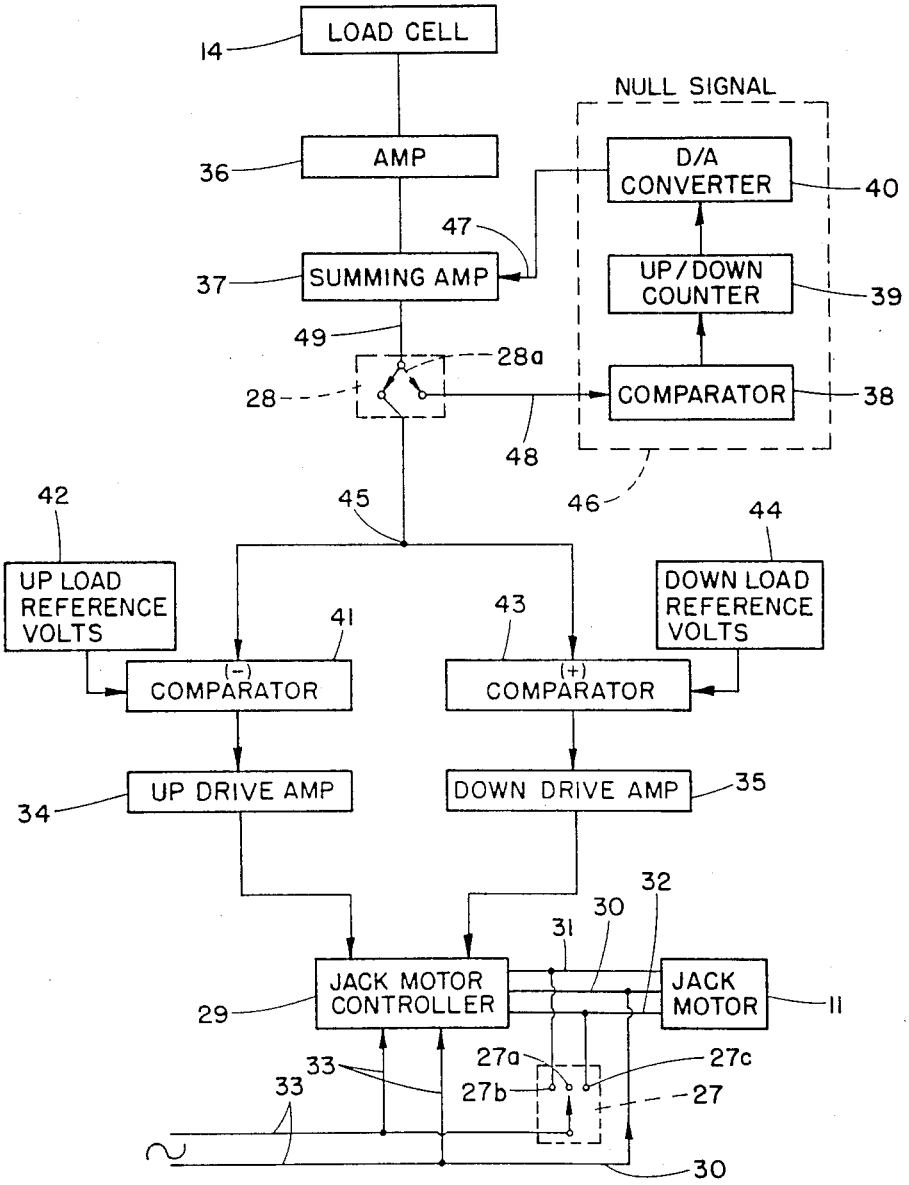
FIG. 4 is a block diagram of a preferred embodiment of the balancer circuit for the hoist.

The balancing arrangement for controlling the operation of motor 11 is illustrated in detail in FIG. 4. FIG. 4 is a block diagram of the preferred embodiment of the present invention used to generate the autobalance signals and control the operation of jack motor 11. The jack motor 11 is a reversible electric motor, the windings of which are driven by the jack motor controller or by switch 27 to rotate in either direction depending upon the set of windings that are excited. Up/down drive switch 27 has a central or neutral position 27*a*, an updrive position 27*b*, and a downdrive position 27*c*. In each case, a common circuit 30 remains connected to the common winding of jack motor 11. In the event updown switch 27 is positioned at 27*b*, the power is connected from the input power line to the updrive winding of jack motor 11 means of circuit 31. In the event switch 27 is thrown to the downdrive position 27*c*, jack motor 11 is driven by means of the downdrive circuit 32. Likewise, jack motor controller 29 may utilize the incoming power line 33 to energize either the updrive circuit consisting of lines 30 and 31, or the downdrive circuit consisting of lines 30 and 32 in response to the output of updrive amplifier 34 or downdrive amplifier 35.

In operation, the load cell 14 generates an actual load signal that is representative of the actual load carried by the electric self balancing hoist. This signal is amplified by means of amplifier 36 and fed to summing amplifier 37. After the operator has manipulated the load into the desired position by means of up/down drive switch 27, he momentarily depresses balance switch 28 repositioning the switch from the configuration illustrated in FIG. 4 to the dotted line configuration indicated at 28*a*. The output of the summing amplifier is then directed to a null signal generating means 46 where it is nulled out by a signal generated by the up/down counter 39 and returned to the summing amplifier 37. The input and output of the up/down counter 39 is converted from analogue form by D/A converter 40. The null signal supplied on line 47 to the summing amplifier 47 nulls out the actual load signal to provide an output of zero from the summing amplifier along line 49. When switch 28 is released, the nulled output is then supplied to junction 45 and comparator circuits 41, 43. When the load is at rest, and the actual load signal has been nulled out or balanced by the null signal generator 46, there will be no input signal to either comparator 41 or 43. If the operator desires to manually move the load downward, he may slightly load the load by pushing it downwardly with a effective force of a few pounds. When the load has been loaded in a downward direction, the load cell 14 will generate an actual load signal which is proportionally larger than the null signal previously generated by the operator. Summing amplifier 37 will subtract the null signal present on line 47 from the actual load cell signal and produce an output signal on 49 that is representative of the difference. When comparator circuit 43 senses a positive output signal that is larger than the download reference voltage supplied by 44 will actuate the downdrive amplifier 35 and the jack motor controller 29 to drive the jack motor downwardly along circuit 30–32.

Conversely, if the operator desired to reposition the load upwardly, the output of load cell 14 would decline, and summing amplifier 37 would then supply a negative signal to junction 45. Comparator 41 would compare the negative signal with the upload reference voltage generated at 42, and if greater, actuate updrive amplifier 34 and jack motor controller 29 to energize the jack motor 11 via circuits 30–31.

The upload and download reference voltages supplied by 42 and 44 are adjustable. This means the upset force needed to initiate movement of the workpiece may vary from one to several pounds. At any point in time, the output of load cell 14 is the actual load signal. The output at 47 is an adjustable null signal, and the signal at junction 45, wherein the null signal has been subtracted from the actual load signal, may be termed the load at rest signal. The output of downdrive amplifier 35 is the updrive signal. The output of reference voltage devices 42 and 44 may be termed first and second predetermined values.

In an alternate form of the invention, the null signal generating means 46 may be replaced with a sample and hold circuit which will generate an adjustable null signal. The sample and hold circuit is energized by a current detector placed in line 30 to be triggered by actual intentional motion of the load by the hoist operator. Upon completion of the load movement, the operator will switch the up/down drive switch 27 to the position illustrated at 27*a*. The output of the current detector would then fall to zero and a reset timer would initiate actuation of the sample and hold circuit. The reset timer would also select a sampling period that would average out any load variations in the actual signal resulting from oscillations of the load resulting from displaceable loading of the support apparatus or, from oscillations of the workpiece itself in the case of a large, bulky and unwieldly workpiece. At the close of the timer period, the sample and hold circuit would then provide a continuous output signal on line 47 representative of the average signal derived during the sample and hold period. The remaining operation of the device would be identical to that previously described with respect to FIG. 4, except that balancing switch 28 would no longer be needed. The automatic initiation of the reset timer by a current detector would select a sample and hold time period appropriate to the load after each movement of the load by the operator through up/down switch 27.

What is claimed is:

1. A self balancing electric hoist for assisting an operator in positioning and manipulating large supported loads, said hoist comprising:

(a) an electric motor means and a non-reversing gear means mounted between a load and a means for supporting a load, said electric motor means responsive to a controller means to raise and lower the load;

(b) load sensor means for supplying an actual load signal representative of the actual load carried by the hoist;

(c) null signal generating means for generating an adjustable null signal to offset the actual load signal;

(d) means for generating an updrive signal for said motor means if the actual load signal exceeds the null signal by a first predetermined value;

(e) means for generating a downdrive signal for said motor means if the actual load signal exceeds the null signal by a second predetermined value;

(f) controller means for energizing said motor means in response to either an updrive signal or a downdrive signal to energize said motor only when raising or lowering said load, whereby an operator may raise or lower the load by manually loading the load in the desired direction of travel to generate an actual load signal that exceeds the null signal by said first or second predetermined value.

2. A self balancing electric hoist as claimed in claim 1, wherein said hoist further includes an elongated overhead support means, and a reciprocal carriage means mounted on said support for supporting the load.

3. A self balancing electric hoist as claimed in claim 1, wherein said hoist further includes a pair of load support means positioned on either side of the center of gravity of a large load to be supported.

4. A self balancing electric hoist as claimed in claim 1 or 2 or 3, wherein the non-reversing gear means comprises a rotating worm screw having a lead angle of 10° or less.

5. A power assist load support means for assisting an operator in moving large supported loads, said means comprising:

(a) a load support means for supporting a load to be moved;

(b) an electric motor means and a non-reversing means for supplying a motive force to move the load, said motor means and said screw means being responsive to a controller means to raise and lower the load;

(c) load sensor means mounted between the load and said support means, said load sensor generating an actual load signal representative of the actual load;

(d) null means for generating an adjustable null signal to offset the actual load signal, and provide a nulled load at rest signal;

(e) means for generating an updrive signal for said motor means when the value of the actual load signal exceeds the value of the nulled load at rest signal by a predetermined amount;

(f) means for generating a downdrive signal for said motor means when the value of the actual load signal exceeds the value of the nulled load at rest signal by a predetermined amount; and (g) controller means for energizing said motor means in response to either an updrive signal or a downdrive signal to energize said motor only when raising or lowering said load;

whereby an operator may raise or lower the load by manually loading the loads in the desired direction of travel.

6. A power assist load support means as claimed in claim 5, wherein said load support means comprises an elongated overhead support means, and a reciprocal carriage means mounted on said support means for supporting the load.

7. A power assist load support means as claimed in claim 5, further comprising a second power assist load support means with a single support means positioned on either side of the center of gravity of a large load to be supported.

8. A power assist load support means as claimed in claims 5 or 6 or 7, wherein the non-reversing gear means comprises a worm gear having a lead angle of 10° or less.

9. A power assist load support means as claimed in claim 8, wherein said electric motor means includes a drum hoist.

10. A portable self balancing electric hoist for assisting an operator in positioning large supported loads, said hoist comprising:

(a) a portable hoist mounted between a load to be supported and a means for supporting the load, said hoist having:

(i) a reversible electric motor means for driving the hoist in response to either an updrive signal or a downdrive signal;

(ii) a rotary to linear conversion means for positioning a load in response to rotation of said motor means said means including a non-reversing gear means between the motor means and the hoist;

(iii) a load cell for measuring actual load supported by the hoist;

(b) means for generating an actual load signal from the output of said load cell;

(c) an autobalance means for generating and storing a variable null signal that will reset said null signal after a timed period to offset the actual load signal at a selected point in time;

(d) means for generating first and second predetermined reference signal values;

(e) means for generating an updrive signal for said motor means when the differences between the actual load signal and the null signal exceed the first predetermined reference signal values;

(f) means for generating a downdrive signal for said motor means when the difference between the actual load signal and the null signal exceeds the second predetermined reference value; and (g) controller means for energizing said motor means in response to either an updrive signal or a downdrive signal to energize said motor only when raising or lowering said load.

11. A portable self balancing electric hoist as claimed in claim 10, wherein said hoist further includes a second portable hoist with a single hoist positioned on either side of the center of gravity of a large load to be supported.

12. A portable self balancing electric hoist as claimed in claim 10, wherein said portable hoist is supported by a reciprocal carriage means mounted on an elongate overhead support.

13. A portable self balancing hoist as claimed in claim 10, wherein the rotary to linear conversion means further includes a gear reduction transmission, a rotary worm screw and a rotating drum hoist.

14. A portable power assist device as claimed in claim 13 or 10 wherein the autobalance means further includes an operator actuated switch means, an up/down counter, a digital to analog converter, and a summing amplifier.

* * * * *